US006275664B1

(12) United States Patent
Wolf et al.

(10) Patent No.: US 6,275,664 B1
(45) Date of Patent: Aug. 14, 2001

(54) PREDICTING SUPPLIES REQUIRED FOR COMPLETION OF UNATTENDED PRINT JOBS

(75) Inventors: Bryan D. Wolf, Caldwell; Kevin A. Owen, Meridian, both of ID (US); Jeffrey Jay Anderson, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/560,536

(22) Filed: Apr. 25, 2000

(51) Int. Cl.[7] ..... G03G 15/00
(52) U.S. Cl. ..... 399/8; 399/23; 399/27
(58) Field of Search ..... 399/23, 24, 27, 399/8; 358/1.14, 1.15

(56) References Cited

U.S. PATENT DOCUMENTS 5,802,420 9/1998 Garr et al. ..... 399/27

FOREIGN PATENT DOCUMENTS 6-138739 * 5/1994 (JP) .

* cited by examiner

*Primary Examiner*—Joan Pendegrass
(74) *Attorney, Agent, or Firm*—Leslie G. Murray

(57) ABSTRACT

A method and apparatus for determining whether or not sufficient consumable supplies such as toner or ink and print media, for example, are available to an imaging device such as a printer to complete a submitted print job. The method determines the amount of selected consumable supplies remaining and, based on the requirements of a submitted print job and historical data gathered over the lifetime of the imaging device, calculates the amount of consumable supplies required for the print job and compares that to the amount of consumable supplies available. If insufficient consumable supplies are available, the user is notified of the condition. The user then knows at the time the print job is submitted that sufficient consumable supplies are available and that the print job will be complete and available at the printer. The user is further notified that specific consumable supplies are in need of replenishment.

9 Claims, 4 Drawing Sheets

PREDICTING SUPPLIES REQUIRED FOR COMPLETION OF UNATTENDED PRINT JOBS

FIELD OF THE INVENTION

The present invention relates generally to image-forming apparatus such as printers, and, more particularly, to the estimation of the amount of ink or toner required to print a document, and further to a method and system for predicting whether or not sufficient consumable supplies remain to complete a print job.

BACKGROUND OF THE INVENTION

A typical image-forming apparatus such as a printer or a copier that uses electrophotographic, ionographic, or magnetographic technologies frequently uses dry powder toner development of an intermediate image created in the image-forming process. Similarly, a printer or other image-forming apparatus that uses thermal inkjet or other liquid ink technologies uses liquid ink to directly form an image on a selected medium. With any of these image-forming technologies, a supply of powder toner or liquid ink is stored in a reservoir from which it is delivered to the image-forming apparatus. In addition to the toner or ink, a supply of print media is stored in an input tray or bin for delivery to the image-forming apparatus as a printing operation proceeds.

For the case of electrophotographic printing, for example, a photoconductor drum is first electrostatically charged. The photoconductor drum is then exposed to an image light pattern, such as that generated by a laser source, for example, which selectively discharges regions on the previously charged photoconductor drum. The photoconductor drum is developed by delivering electrostatically charged toner particles to the surface of the drum where the charged particles selectively adhere to appropriately charged regions of the drum to form an image corresponding to the image light pattern. The electrostatically transferred toner image is transferred to paper or other print media and is then thermally fused to the paper. Any residual toner is cleaned from the surface of the photoconductor drum prior to reinitiating of the image-forming process. Such a process is applicable to color as well as monochrome printers.

According to the above steps, it is clear that an adequate supply of consumable printer supplies such as toner or ink and print media is critical. A lack of toner or ink can result in the onset of unacceptable print quality with consequential waste of resources, such as print media, while unacceptable quality printing continues. Of course, a lack of print media, paper, for example, results in a suspension of the print job until the supply of paper is replenished.

Users appreciate knowing the amount of consumable supplies available in a printing device, especially prior to starting a print or copy job. This is particular true in the case of a "remote" printing device in which the user is working at a host computer that is connected via some type of network to the remote printing device. Typically, a networked remote printing device may be located several hundred feet from the user, or may even be located in another building. Since the user cannot view the printing device without going to the printing device, the user is, typically, unaware of the amount or conditioner of the consumable supplies available to the printing device prior to sending a print job. A frequent result of this unawareness is finding that the printing device ran out of ink or toner, or paper, in the middle of a print job when the user goes to the printing device to collect the print job. Typically, this results in a waste of both time and resources as the entire print job has to be printed a second time after the printing device has be replenished with the appropriate consumable supplies.

While most printers, copiers, and other imaging devices include the capability to measure or track and report consumable supplies such as ink or toner and print media, typically a "toner low", for example, or "out of paper" condition is not reported until the condition already exists. In particular, for most printing or copying devices, the only way that a user knows that the device is out of print media, is the suspension of the print job. Further, in most devices, the report is only made at the printer or copier control panel. Again, then, in the case of networked, remote printing devices, typically the user has no way of knowing the condition of the consumable supplies for the printing device prior to sending a print job without actually going to the device to check.

According there is a need for a user to know whether or not sufficient consumable supplies are available to a remote printing device prior to the user sending a print job to the printing device thus allowing the user to more accurately know in advance that the print job will be completed.

SUMMARY OF THE INVENTION

In a preferred embodiment, the present invention provides a method and apparatus which determines whether or not sufficient consumable supplies such as toner or ink and print media, for example, are available to an imaging device such as a printer, for example, to complete a submitted print job. The method according to the present invention determines the amount of selected consumable supplies remaining and, based on the requirements of a submitted print job and historical data gathered over the lifetime of the imaging device, calculates the amount of consumable supplies required for the print job and compares that to the amount of consumable supplies available. If insufficient consumable supplies are available, the user is notified of the condition. Thus the user knows at the time the print job is submitted that sufficient consumable supplies are available and that the print job will be complete and available at the printer, and does not waste time and resources when it is discovered that the job is only partially complete waiting for print media to be added or that the print quality is unacceptable.

In a preferred embodiment of the present invention, a network printer located remotely from a host computer includes a reservoir containing a marking agent or material for creating images on a print media, and an input tray for holding a supply of print media to be fed to the printer on a sheet-by-sheet basis as required for processing print jobs. The printer also includes a sensing system for detecting the level or amount of marking material remaining in the reservoir, a media sensing system for detecting the number of sheets of print media remaining in the input tray, and a marking material usage manager application to collect and store historical data related to marking material usage by the printer over the printer lifetime. The printer further includes a processor for estimating, based on the data provided by the sensing systems and the marking material usage manager application, whether or not sufficient consumable supplies are available to the printer to complete a given submitted print job.

In another preferred embodiment, the present invention may be implemented as a method for determining whether or not sufficient marking material remains to complete a print job submitted by a user utilizing the printer described above. The method preferably includes determining the amount of marking material remaining in a reservoir and the number of sheets of print media remaining in an input tray. The average amount of marking material required per printed page and the number of pages in a submitted print job is then calculated to determine the amount of marking material required to print the submitted print job. The amount of marking material required to print the print job and the amount of marking material remaining is compared to determine if sufficient marking material is available to complete the print job. Similarly, the number of pages required for the print job is compared to the number of sheets of print media remaining to determine if sufficient print media is available to complete the print job. The user is notified in the event insufficient marking material or print media, or both, is available to complete the submitted print job. In a preferred embodiment, the user is notified by displaying a notification message on a visual monitor. In one preferred embodiment, the user may increase the confidence level of the determination by modifying the historical data using a calculated standard deviation when calculating the amount of marking material required per printed page.

Other embodiments and advantages of the present invention will be readily appreciated as the same become better understood by reference to the following detailed description, taken in conjunction with the accompanying drawings. The claims alone, not the preceding summary or the following detailed description, define the invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the following detailed description illustrate by way of example the principles of the present invention. The components in the drawings are not necessarily to scale, emphasis instead being placed upon clearly illustrating the principles of the present invention. In the drawings like reference numbers indicate identical or functionally similar elements throughout the several views thereof, and wherein.

DETAILED DESCRIPTION OF THE INVENTION

Figure 1:
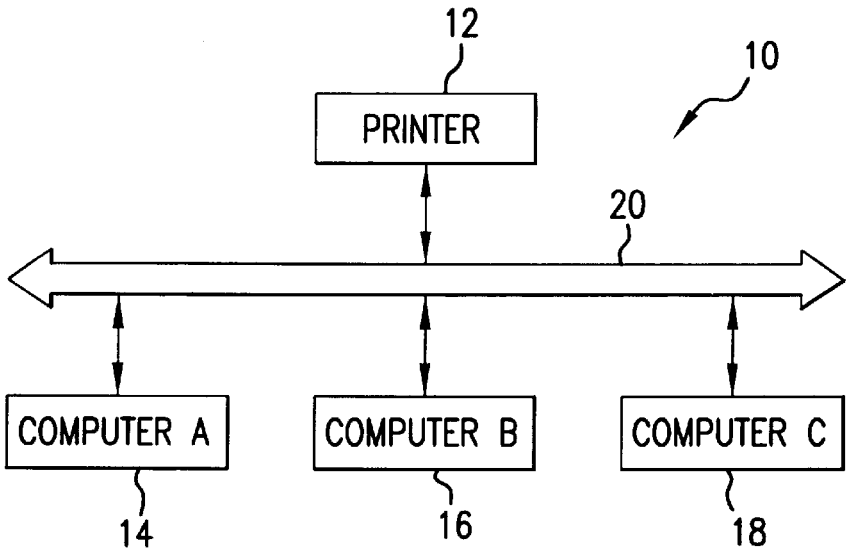
FIG. 1 is a schematic block diagram of a network operating environment having a printer adapted to carry out the present invention and coupled to one or more host computers.

As shown in the drawings for purposes of illustration, the present invention is preferably embodied in a method and apparatus which determines whether or not sufficient consumable supplies such as toner or ink and print media, for example, are available to an imaging device such as a printer, for example, to complete a submitted print job. The method according to the present invention determines the amount of selected consumable supplies remaining and, based on the requirements of a submitted print job and historical data gathered over the lifetime of the imaging device, calculates the amount of consumable supplies required for the print job and compares that to the amount of consumable supplies available. If insufficient consumable supplies are available, the user is notified of the condition. Most existing imaging devices and systems do not provide a positive indication to the user when insufficient consumable supplies are available to complete a submitted print job.

Referring now to FIG. 1, a computer network environment 10 including at least one image-forming device 12 remotely coupled to one or more host computers 14, 16 and 18 via a communications network 20 and adapted to receive print jobs from the host computers over the communications network 20 is shown. For the purposes of this disclosure, the image-forming device 12 is in the form of a laser printer 12 that employs an electrophotographic drum imaging system, as well known in the art. However, as will be obvious to those of ordinary skill in the art, the present invention is similarly applicable to other types of printers and/or imaging devices including, for example, inkjet printers, facsimile machines, copiers, or the like. In a preferred embodiment, the communications network 20 is in the form of a local area network (LAN). Host computers 14, 16 and 18, and laser printer 10 can be connected together via JETADMIN™ LAN ethernet connections available from Hewlett-Packard Company. Preferably, corresponding hardware includes a JetDrive™ multiprotocol EIO, an ethernet card that spools out print jobs from the network 20 available from Hewlett-Packard Company. However, in other embodiments, the communications network 20 may be a wide area network (WAN) or the internet, for example, a host computer may be directly connected to a printing device. Any one of the host computers 14, 16 and 18 can send a print job to the printer 12 with each computer having a printer driver (not shown) for formatting a print job for delivery to the printer 12.

Figure 2:
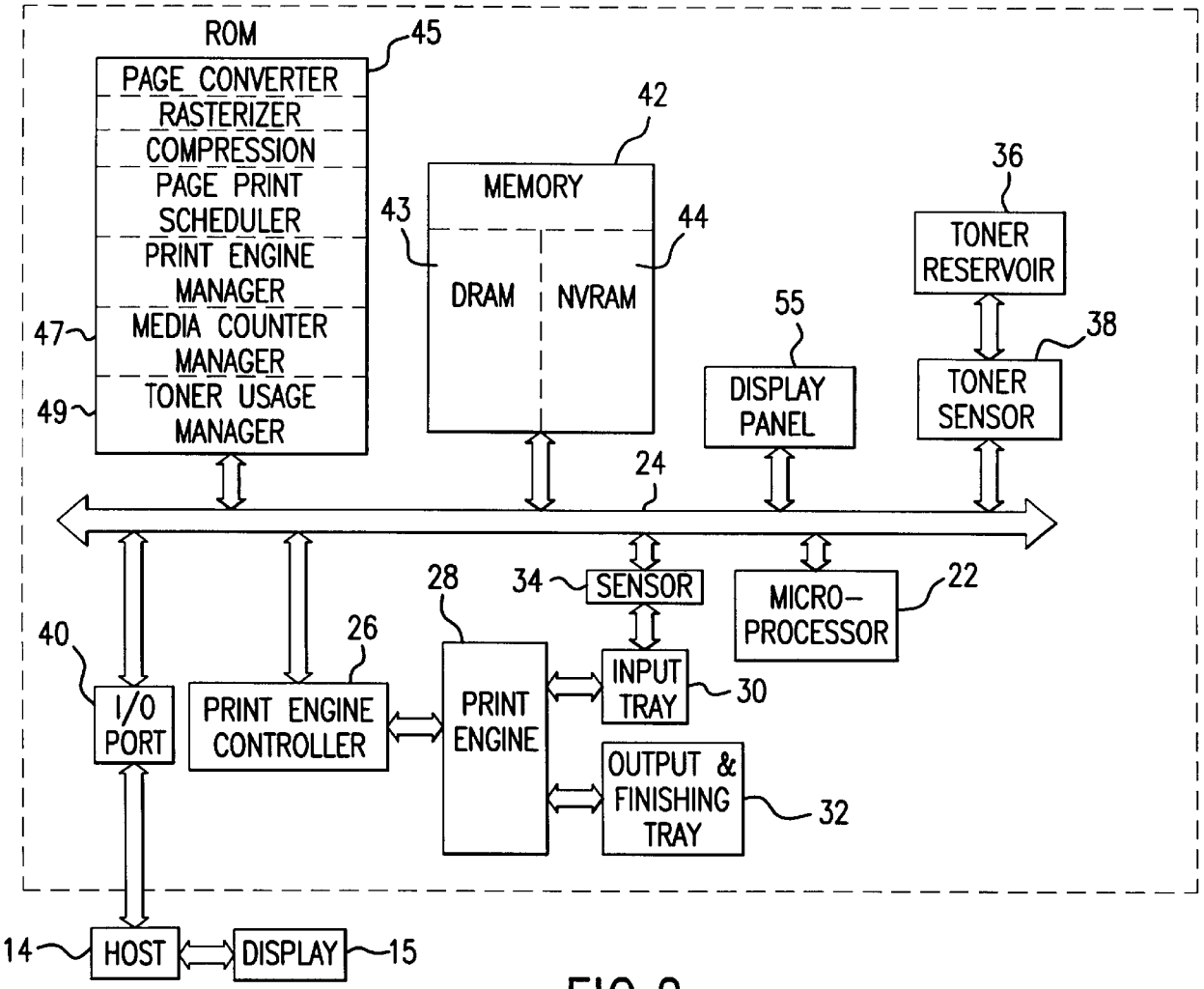
FIG. 2 is a block diagram of the printer of FIG. 2 embodying the present invention apparatus and method for determining whether or not sufficient consumable supplies are available to complete a print job.

Referring now also to FIG. 2, a block diagram of a preferred embodiment of laser printer 12 in accordance with the present invention is shown. Laser printer 12 is controlled by a microprocessor 22 which communicates with other elements of the system via bus 24. A print engine controller 26 and associated print engine 28 connect to bus 24 and provide the print output capability for the laser printer 12. A toner reservoir 36 contains a supply of toner, providing the toner to the print engine as required. A toner sensor 38 is coupled to the toner reservoir 36 and senses the amount of toner in the toner reservoir 36. Sheets of print media, such as paper, is pulled from input paper tray 30 into print engine 28 and directed to output tray or bin 32. A media level sensor 34 is coupled to input tray 30 and detects coarse granularity levels of print media in tray 30. For the purpose of this disclosure, only one toner reservoir 36 and one input paper tray are shown. However, as is well known in the art, most printers and other printing devices can include multiple toner or ink reservoirs; for example, a color printer may include at least three or four ink or toner reservoirs to provide the required color planes. Similarly, most printers and other printing devices include several print media supply trays to provide a user a choice of print media without the necessity of reloading a single media tray each time it is desired to use a different print media.

An input/output port 40 provides communications via LAN 20 between the laser printer 12 and one or more host computers 14. Host computer 14 includes a printer driver (not shown) which provides page descriptions (i.e., raster data) and a page count (i.e., the number of pages) to the laser printer 12 for print jobs to be processed by the laser printer. The host computer 14 further includes a visual monitor 15 for displaying various information and messages concerning print jobs sent to the laser printer 12 for processing, including notification that a print job cannot be completed because sufficient toner and/or print media is not available to the print engine 28. A memory module 42 provides dynamic random access memory (DRAM) 43 which serves as a main memory for the laser printer for storing and processing a print job data stream received from the host computer 14. Memory module 42 also provides non-volatile random access memory (NVRAM) 44 for long term storage and accumulation of toner usage on a per page basis over the laser printer 12 lifetime. Preferably, NVRAM 44 may be any of various types of solid state memory or magnetic memory, such as a magnetic disk drive, for example. A read only memory (ROM) 45 holds firmware which controls the microprocessor 22 to implement the present invention as well as firmware which controls the operation of the microprocessor 22 and the laser printer 12.

The code procedures stored in ROM 45 include a page converter, rasterizer, compression code, page print scheduler and print engine manager. The page converter firmware converts a page description received from the host computer to a display command list, with each display command defining an object to be printed on the page. The rasterizer firmware converts each display command to an appropriate bit map (rasterized strip) and distributes the bit map into DRAM 43 for holding the rasterized strips. The rasterized strips are passed to print engine 28 by print engine controller 26, thereby enabling the generation of an image (i.e., text, graphics etc.). The page print scheduler controls the sequencing and transferring of page strips to the print engine controller 26. The print engine manager controls the operation of the print engine controller 26 and, in turn, print engine 28. The code procedures stored in ROM 45 further include a media counter manager 47 and a toner usage manager 49 for tracking media and toner usage and providing the required data to the microprocessor 22 to calculate whether or not sufficient print media and/or toner is available to the printer 12 to complete a submitted print job.

Figure 3:
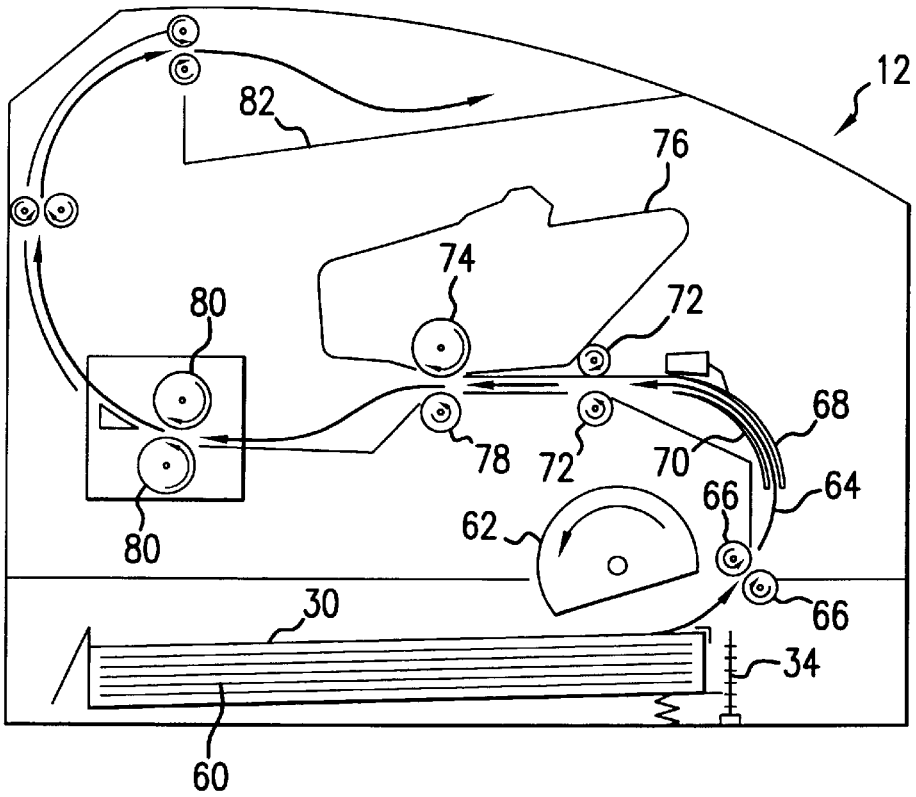
FIG. 3 is a schematic diagram of the laser printer of FIG. 2.

The media counter manager 47 calculates (approximates) the number of sheets of print media 60 or paper (as shown in FIG. 3) in input tray 30. Media counter manager 47 receives coarse granularity level values of media in input tray 30 detected by sensor 34. As disclosed in greater detail in U.S. Pat. No. 5,960,230 assigned to Hewlett-Packard Company and hereby incorporated by reference as if it were reproduced in its entirety herein, using the number of sheets of print media 60 from input tray 30 actually used during print job processing in the printer 12, the media counter manager 47 determines the number of sheets between coarse granularity levels. The number of sheets between coarse granularity levels is then used to calculate (approximate) the number of sheets of print media 60 remaining in the input tray 30. The calculated number of sheets remaining in input tray 30 is stored and/or coupled to the microprocessor 22. In a preferred embodiment, the calculated number of sheets of print media remaining in the input tray 30 is displayed on the printer display panel 55.

The toner usage manager 49 calculates the number of sheets or pages of printed images (i.e., text, graphics etc.) which can be produced by the print engine 28 given the amount of toner remaining in reservoir 36 and available to the print engine 28. The toner usage manager 49 receives toner remaining values providing the amount of toner remaining in toner reservoir 36 detected by toner sensor 38. As explained in greater detail below with reference to FIG. 4, the toner usage manager 49 uses the toner usage over the printer lifetime to calculate an average amount of toner required per page. The amount of toner remaining in the toner reservoir 36 and the average amount of toner required per printed page is then used to calculate the number of pages which can be printed with the amount of toner available to the print engine 28. One or more standard deviations on the calculated average amount of toner required may be added to the average amount of toner required to increase the accuracy of the result and provide a greater confidence level for the user.

Referring now also to FIG. 3, a schematic block diagram of laser printer 12 of FIG. 1 is shown. Input paper tray 30 holds sheets of print media 60. Feed roller 62 picks top sheet 64 from media stack 60 in input tray 30 and advances it to a pair of transport rollers 66. Transport rollers 66 further advance sheet 64 through paper guides 68 and 70 toward registration rollers 72. Registration rollers 72 advance paper sheet 64 to the photoconductive drum 74 (of toner cartridge 76) and transfer roller 78 where toner is applied as is conventional in the art. Sheet 64 then moves through heated fuser rollers 80 and toward an output paper bin 82.

Media level sensor 34 is coupled to input tray 30 and detects coarse granularity levels of media in input tray 30. Sensor 34 may be any conventional sensor in the art, such as ratchet or light sensor, that is capable of detecting and reporting a plurality of course granularity levels of print media in input tray 30. The media count manager 47 (as shown in FIG. 2) calculates an actual or approximate media count using the course granularity levels reported by sensor 34.

Figure 4:
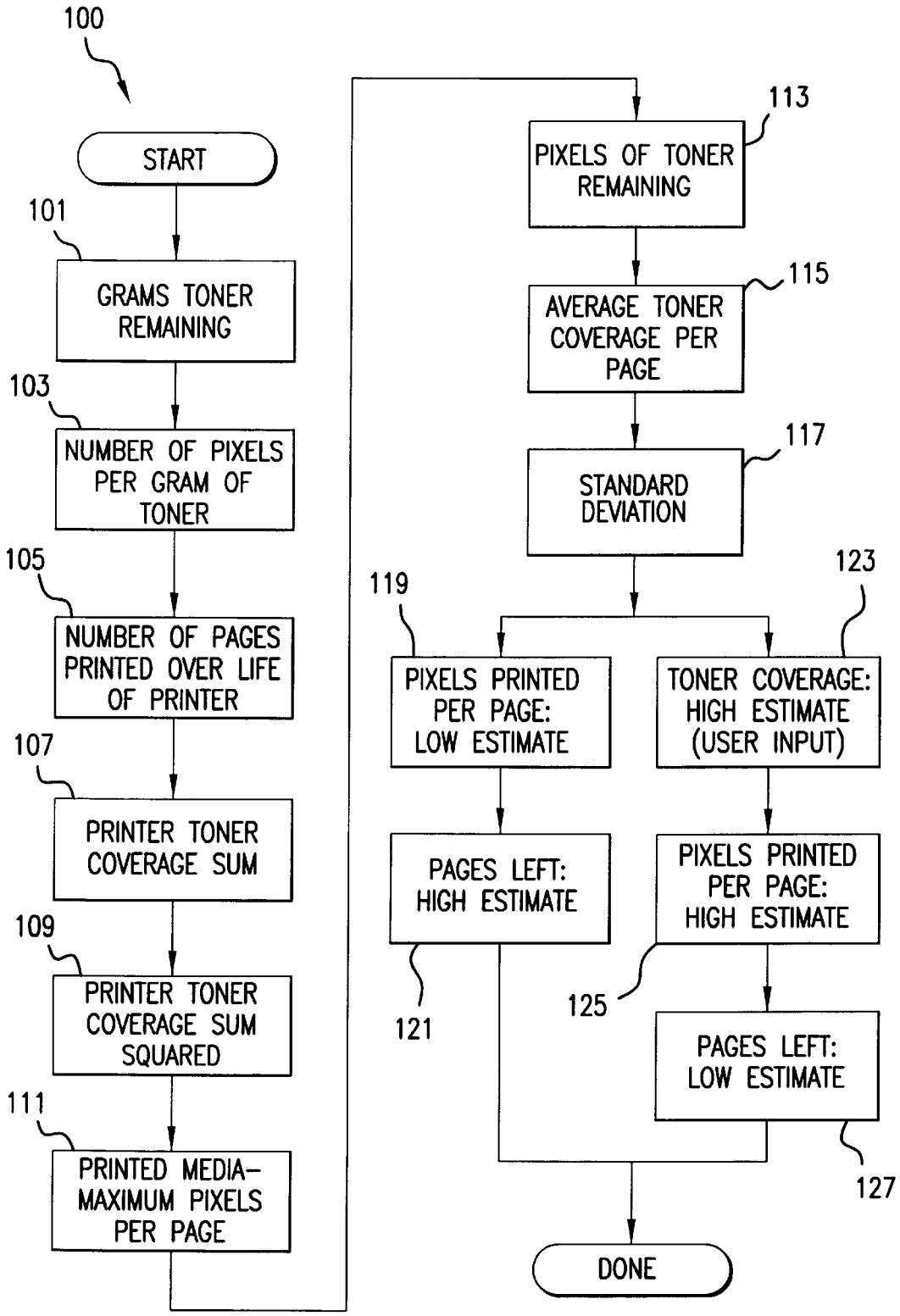
FIG. 4 is a flow chart depicting a preferred method of calculating the number of pages that can be printed according to the principles of the present invention.

Referring now also to FIG. 4, a flow chart depicting a preferred method of calculating the number of pages that can be printed based on the consumable supplies available to a printer according to the principles of the present invention is shown. In order to insure that a given print job can be completed (i.e., printed), the amount of toner required to print the print job and the amount of toner available to the print engine 26 (i.e., the amount of toner remaining in toner reservoir 36) must be known. Process 100 calculates the number of pages that can be printed when the amount of toner remaining is known. At step 101, the amount of toner, in grams, remaining in toner reservoir 36 as detected by toner sensor 38 is received. Toner sensor 38 may be any of various toner level sensing devices and systems as is well known in the art. In a preferred embodiment, toner sensor 38 comprises the toner level detection system disclosed in U.S. Pat. No. 5,794,094 hereby incorporated by reference as if fully reproduced herein in its entirety. For additional examples of toner level detection systems, see U.S. Pat. Nos. 5,815,768 and 5,655,174. As is well-known in the art, not all of the toner (or liquid ink in the case of an inkjet printer, for example) is usable. As toner is extracted from a reservoir and used, at some level of toner in the reservoir, insufficient toner remains to produce the print quality required. Most toner level detection systems compensate for this unusable toner to provide the amount of toner remaining which will provide the required print quality. At step 103, the number of pixels which can be printed per gram of toner is calculated.

Each print job is sent from host computer 14 to laser printer 12 via LAN 20 in the form of a data stream. The data stream defines how many pixels, as well as the location of the pixels, within each page of a document to be printed. Over the lifetime of the printer 12, the toner usage manager 49 collects and stores historical data in NVRAM 44 for each print job processed by the printer 12. The database thus formed includes total number of pages printed, number of pixels per page and the toner coverage per page (the amount of toner on a page divided by the amount of toner required to completely cover the page). In process 100, at steps 105 and 107, the total number "N" of pages and the toner coverage sum "C" for all pages printed is retrieved from NVRAM 44. In a preferred embodiment, a page counter is incremented every time a page is printed, and, as each page is printed, the percentage of toner coverage for that page is calculated and added to an accumulator to provide a single value C representing the sum of the percentage toner coverage for all pages printed over the lifetime of the printer. Similarly, at step 109, a value "CS" is retrieved for NVRAM 44 which represents the sum of the toner coverage squared for all pages printed over the lifetime of the printer. As described above, as each page is printed, the percentage of toner coverage for that page is calculated, then squared and added to an accumulator to provide a single value CS representing the sum of the percentage toner coverage squared for all pages printed over the lifetime of the printer. At step 111, the maximum number of pixels per printed page (i.e., the page is 100 percent covered by toner) is retrieved from NVRAM 44. This value is calculated once for each type of media and stored in a lookup table contained in NVRAM 44. At step 113, the number of pixels of toner remaining is calculated by multiplying the grams of toner remaining (step 101) by the number of pixels per gram of toner (step 103). At step 115, the average toner coverage per page is calculated by dividing toner coverage sum C (step 107) by the total number N (step 105) of pages. At step 117, the standard deviation on the average toner coverage per page is calculated. The standard deviation is given by:

$$\text{standard deviation}=\text{square root}\ ((CS-(C^2/N))/(N-1)).$$

The microprocessor 22 can perform the above calculations to whatever degree of accuracy is adequate or desired. As a function of the level of assurance or confidence provided that a particular print job can be completed, the value used for toner coverage per page can be varied. Using the calculated average toner coverage per page (step 115) will guarantee that there is sufficient toner available for a print job at least 50 percent of the time. The average plus one or more standard deviations will increase this percentage. For example, the average plus one standard deviation will guarantee that there is sufficient toner available to complete a given print job approximately 84 percent of the time; average plus two standard deviations increases the percentage to 98 percent. The average toner coverage C plus three standard deviations guarantees that there is sufficient toner available to complete virtually 100 of the print jobs submitted.

Proceeding now to step 119, the number of pixels printed per page is calculated by multiplying the average toner coverage C per page (step 115) by the maximum number of pixels per page (step 111). At step 121 the number of pages that can be printed with the amount of toner remaining in the toner reservoir 36 is calculated by dividing the pixels of toner remaining (step 113) by the pixels printed per page (step 119). Alternately, proceeding to step 123 (from step 117) the toner coverage per page is calculated using the average toner coverage C per page (step 115) and adding one or more standard deviations (step 117). The number of standard deviations added may be set during manufacture or may be determined by system administrator or user input. At step 125, the pixels printed per page (high estimate) is calculated by multiplying the above-calculated toner coverage per page (step 123) by the maximum number of pixels per page (step 111). At step 127 the number of pages that can be printed with the amount of toner remaining in the toner reservoir 36 is calculated by dividing the pixels of toner remaining (step 113) by the pixels printed per page (step 125). As discussed, adding one or more standard deviations to the average toner coverage C increases the confidence level that the number of pages that can be printed with the remaining toner is sufficient to complete a given print job, it also increases the amount of toner per page thus reducing the estimated number of pages which can be printed. Thus, the number of pages left, low estimate (step 127) is fewer than the number of pages left, high estimate (step 121).

The above-described process for calculating the average amount of toner required per printed page is directly specifically to a laser printer. However, as is well known in the art, a similar process is typically employed for calculating the average amount of liquid ink required to cover a printed page in an inkjet printer. One notable difference is that in an inkjet printer, a portion of the ink used to print a page does not directly result in marks on the page, but rather is used to "clear" the ink nozzles and maintain the operation of the inkjet printhead (not shown). The amount of liquid ink required to clear the nozzles typically amounts to 1 to 3 percent of the total ink required to print a page.

Figure 5:
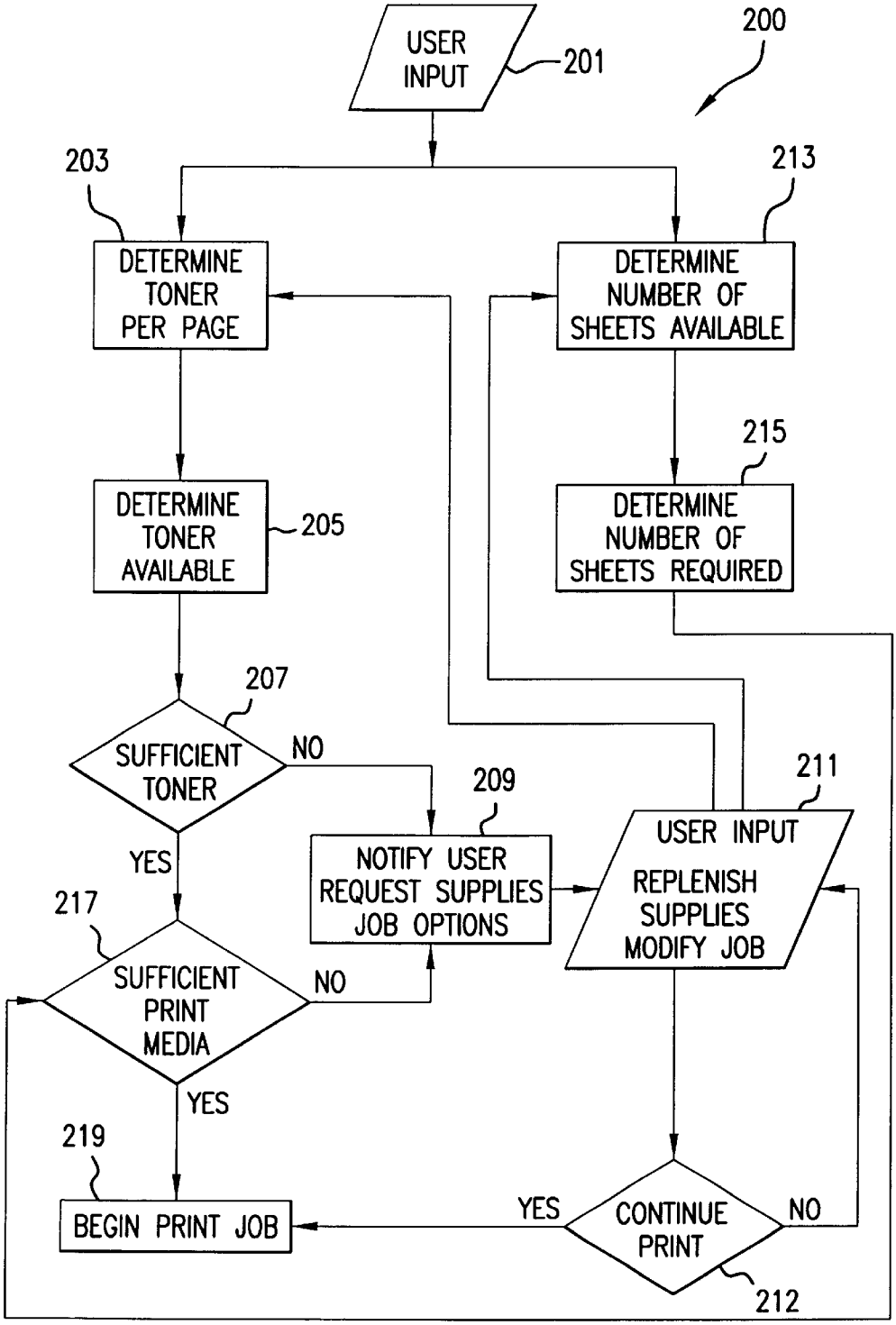
FIG. 5 is a flow chart depicting a preferred method of determining whether or not sufficient supplies are available to an imaging device to complete a print job according to the principles of the present invention.

Referring now also to FIG. 5, a flow chart depicting a preferred method of determining whether or not sufficient supplies are available to an imaging device to complete a print job according to the principles of the present invention is shown. Process 200 determines whether or not sufficient consumable supplies are available to the printer 12 to complete a print job submitted by a user at host computer 14, for example. In a preferred embodiment, as shown in FIG. 5, the consumable supplies include the image marking agent or material, such as powder toner or liquid ink, for example, and the number of sheets of print media available to an imaging device 12, such as a laser printer, for example. Process 200 begins at step 201 when a user at a host computer 14 submits a print job to printer 12. Submission of a print job includes the image data stream, the number of prints or copies of the print job required, the number of pages in the print job and the type of print media to be used which, in turn, identifies which input tray 30 will be used to process the print job. In a preferred embodiment, at the time the print job is submitted, the user may also input a "confidence level" by specifying one or more standard deviations (as described with reference to FIG. 4) be added to the average toner coverage C per page. Proceeding now to step 203, the amount of toner required per page is determined (as described with reference to FIGS. 2 and 4). At step 205, the amount of toner remaining in toner reservoir 36 available to the print engine 26 as detected by toner sensor 38 is received. At step 207, whether or not sufficient toner remains to complete the submitted print job is determined using the number of pages required by the print job, the toner required per page (step 203) and the toner available (step 205). If sufficient toner or other marking material is available to the print engine 26, the process 200 proceeds to step 217 to determine if sufficient print media is available. Prior to step 217, at step 213, the number of sheets of the specified print media available in input tray 30 is determined as described with reference to Fig.2, and the media counter manager 47 and sensor 34. At step 215, the number of sheets required to complete the submitted print job is determined from the user inputs at step 201. At step 217, then, whether or not sufficient print media is available to complete the job is determined by comparing the number of sheets available (step 213) with the number of sheets required (step 215). If sufficient print media is available to complete the submitted print job, then the process 200 proceeds to step 219 and printing of the print job begins. At step 209, if insufficient toner or print media, or both, remains to complete the print job, the user is notified of the condition. In a preferred embodiment, a notification message is displayed at the host computer visual monitor 15 and may include a request that the appropriate consumable supply, toner or print media, or both, be replenished, and/or provide the user with the option to proceed with executing the print job. At step 211, the user or system administrator adds the appropriate supplies and the process 200 returns to step 203 or step 213. In a preferred embodiment, the user or system administrator is also given the option to modify the print job so it can be processed completely with the available supplies. Additionally, at step 212, the user can be given the option to continue to process the submitted print job using the available toner and media. If the user chooses to continue the print job, the process 200 proceeds to step 219 and begins printing the submitted print job. If the user chooses not to continue the print job, the process 200 returns to step 211 where the user or system administrator adds the requires supplies or modifies the submitted print job.

In addition to the foregoing, the logic of the present invention can be implemented in hardware, software, firmware, or a combination thereof. In the preferred embodiment(s), the logic is implemented in software or firmware that is stored in a memory and that is executed by a suitable instruction execution system. If implemented in hardware, as in an alternative embodiment, the logic can be implemented with any or a combination of the following technologies, which are all well known in the art: a discrete logic circuit(s) having logic gates for implementing logic functions upon data signals, an application specific integrated circuit (ASIC) having appropriate logic gates, a programmable gate arrays(s) (PGA), a field programmable gate array (FPGA), etc.

Also, the flow charts and diagrams of FIGS. 2, 4 and 5 show the architecture, functionality, and operation of a possible implementation of the logic. In this regard, each block represents a module, segment, or portion of code, which comprises one or more executable instructions for implementing the specified logical functions). It should also be noted that in some alternative implementations, the functions noted in the blocks may occur out of the order noted in FIGS. For example two or more blocks shown in succession in FIGS. 2, 4 and 5 may in fact be executed substantially concurrently or the blocks may sometimes be executed in the reverse order, depending upon the functionality involved.

Finally, the logic which comprises an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer-readable medium can be, for example, but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM)(magnetic), a read-only memory (ROM)(magnetic), an erasable programmable-read-only memory (EPROM or Flash memory), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

While having described and illustrated the principles of the present invention with reference to various preferred embodiments and alternatives, it will be apparent to those familiar with the art that the invention can be further modified in arrangement and detail without departing from those principles. Accordingly, it is understood that the present invention includes all such modifications that come within the terms of the following claims and equivalents thereof.

What is claimed:

1. In a printer network including a host computer and at least one printing device wherein a reservoir contains a marking material for creating images on a print media, and includes a means for determining the amount of marking material in the reservoir and a processor, a method for determining whether or not sufficient marking material remains to complete a print job submitted by a user, comprising the steps of:

determining an average amount of marking material required per printed page, wherein the average amount of marking material required per printed page comprises the average amount of marking material required for all previously printed pages over the lifetime of the printing device, the amount of marking material required for each printed page being calculated as the page is printed;

calculating a standard deviation for the amount of marking material required for all previously printed pages;

determining the amount of marking material remaining in the reservoir;

determining the number of pages in a submitted print job;

calculating the amount of marking material required to print the submitted print job; and notifying the user in the event insufficient marking material remains in the reservoir to complete the submitted print job.

2. The method as in claim 1 wherein the at least one printing device includes a print media input tray for storing sheets of print media and means for determining the number of sheets of print media remaining in the print media input tray, comprising the further steps of:

determining the number of sheets of print media remaining in the print media input tray;

calculating the number of sheets of print media required to print the submitted print job; and notifying the user in the event insufficient print media remains in the print media input tray to complete the submitted print job.

3. The method of claim 2 wherein the printing device comprises a laser printer, and the marking material comprises toner.

4. The method of claim 2 wherein the printing device comprises an inkjet printer, and the marking material comprises ink.

5. The method of claim 1 wherein a predetermined number n times the standard deviation is added to the average amount of marking required per printed page.

6. The method of claim 4 wherein n can take the values 1, 2 or 3.

7. The method of claim 1 wherein the step of notifying the user in the event insufficient marking material remains in the reservoir to complete the submitted print job comprises the step of displaying the notification on a visual monitor at the host computer.

8. A computer program product for determining whether or not sufficient consumable supplies are available to complete a print job submitted to an imaging device by a user and displaying a notification message to the user in the event insufficient consumable supplies are available to complete the submitted print job, the computer program product comprising:

a computer usable medium having computer readable program code means embodied therein for causing a computer to:

determine the amount of a marking material available to a printer;

determine the amount of print media available to the printer;

determine an average amount of marking material required per printed page, wherein the average amount of marking material required per printed page comprises the average amount of marking material required for all previously printed pages over the lifetime of the printing device, the amount of marking material required for each printed page being calculated as the page is printed;

calculate a standard deviation for the amount of marking material required for all previously printed pages;

determine the number of pages in a submitted print job;

calculate the amount of marking material required to print the submitted print job; and notify the user in the event insufficient marking material or print media is available to complete the submitted print job.

9. The computer program product of claim 8 wherein the computer readable program code means further causes the computer to display to the user a notification message.

* * * * *